US005174651A

United States Patent [19]

Gaddis

[11] Patent Number: 5,174,651

[45] Date of Patent: Dec. 29, 1992

[54] LOW SHEAR POLYMER DISSOLUTION APPARATUS

[75] Inventor: Preston G. Gaddis, Bartlesville, Okla.

[73] Assignee: Gaddis Petroleum Corporation

[21] Appl. No.: 667,810

[22] Filed: Mar. 12, 1991

[51] Int. Cl.[5] ..... B01F 5/04; B01F 15/04; B01F 5/06

[52] U.S. Cl. ..... 366/167; 366/177; 366/332; 366/339; 366/160; 366/152; 210/408; 210/413

[58] Field of Search ..... 241/166; 210/388, 396, 210/408, 413, 407; 366/160, 336, 337, 338, 339, 14, 184, 235, 255, 256, 257, 156, 150, 168, 310, 312, 313, 167, 177, 332, 152

[56] References Cited

U.S. PATENT DOCUMENTS

| | | | |
|---|---|---|---|
| 782,950 | 2/1905 | Dion | 210/413 |
| 2,465,579 | 3/1949 | Eduards | 210/413 |
| 2,949,934 | 8/1960 | Schrenk . | |
| 3,189,080 | 6/1965 | Overcashier | 366/168 |
| 3,365,065 | 1/1968 | Varjabedian | 210/413 |
| 3,468,322 | 9/1969 | Katzer . | |
| 3,722,681 | 3/1973 | Boorujy | 210/408 |
| 3,807,701 | 4/1974 | Reid et al. . | |
| 3,901,320 | 8/1975 | Calderon | 210/408 |
| 4,013,272 | 3/1977 | Routson . | |
| 4,217,145 | 8/1980 | Gaddis . | |
| 4,518,261 | 5/1985 | Sekimoto | 366/150 |
| 4,522,502 | 6/1985 | Brazelton . | |
| 4,664,652 | 5/1987 | Rodgers et al. . | |
| 4,846,582 | 7/1989 | Davidsson | 366/150 |
| 4,849,182 | 7/1989 | Leutzelschwab . | |
| 4,929,086 | 5/1990 | Geyer . | |

FOREIGN PATENT DOCUMENTS

| | | | |
|---|---|---|---|
| 3218555 | 11/1983 | Fed. Rep. of Germany | 366/156 |
| 0087838 | 5/1985 | Japan | 366/150 |
| 692266 | 6/1953 | United Kingdom | 210/413 |
| 1209603 | 10/1970 | United Kingdom | 366/339 |

OTHER PUBLICATIONS

Union Carbide Corporation brochure, "Polyox Water Soluble Resins: How to Dissolve POLYOX® Water-Soluble Resins".

*Primary Examiner*—Philip R. Coe
*Assistant Examiner*—Randall Edward Chin
*Attorney, Agent, or Firm*—Richards, Medlock & Andrews

[57] ABSTRACT

A continuous, low shear solids dissolution system involving a water supply system (100), polymer metering system (120), mixture feed tank (152), mixture pump (154), mixture transport conduit (172), undissolved polymer dispersal element (188), solution sieve assembly (210), and holding tank (250). The polymer-water mixture (156) is pumped through mixture transport conduit (172). Undissolved particles of polymer encounter dispersal elements (188) and the particles are more uniformly dispersed. Any particles which are carried undissolved out of the mixture transport conduit (172) are forced through sieve (214) to further disperse the polymer in the water. The undissolved polymer is completely dissolved by low shear agitation in a holding tank (250).

9 Claims, 2 Drawing Sheets

LOW SHEAR POLYMER DISSOLUTION APPARATUS

TECHNICAL FIELD OF THE INVENTION

The present invention relates to a method and apparatus for dispersing solid particles into a liquid. In one aspect, the invention relates to a low shear method and apparatus for dispersing solids into a liquid. In a particular aspect, the invention relates to a constant flow low shear method and apparatus for dissolving water-soluble polymers into water.

BACKGROUND OF THE INVENTION

A recurring problem with dispersing solids, such as polymers, into a liquid is that the solids form clumps which are less readily dispersed than small particles. The invention relates to the dissolution of solids in a liquid solvent and dispersion of solids into a liquid in colloid form. It will be described in terms of a particular aspect, the dissolution of polymers into water. Many techniques have been developed for mixing and dispersing soluble polymers in water. Conventionally the polymers are dispersed directly into the water and subjected to mechanically induced agitation in a batch process. See, for example, U.S. Pat. No. 3,807,701. It is also known that good mixing can be achieved in turbulent streams of water. U.S. Pat. No. 3,468,322 is an example of a turbulent mixing system.

Problems are often encountered in the use of conventional mixing techniques to dissolve polymers, especially water-soluble polymers in water. In order to dissolve quickly and easily, uniform initial dispersion of the polymer is essential. To avoid agglomeration of the polymer in the water and resulting slow dissolution rate for the agglomerates, severe mechanical agitation may be used to overcome poor initial dispersion. High shear agitation has the disadvantage that when applied to polymer systems, the molecules may be broken down and the polymer lose some of its desired properties.

In addition to damage caused by high shear, another problem with batch systems is that they involve high power requirements. In order to ensure complete dissolution in a reasonable period of time, excessive agitation is used. This has the problems discussed earlier, i.e. that the solids being dissolved may be damaged. It also leads to excessive use of energy.

Another approach to the dissolution of polymers in water is to predisperse the polymer in a water-miscible non-solvent. The non-solvent liquid helps prevent agglomeration of the polymer particles until complete dissolution has occurred. This method is often not desirable because the additional non-solvent liquid must be removed, an unnecessary additional step. Even when the non-solvent is not removed, the non-solvent liquid adds to the cost of the operation and requires an additional preparatory step.

A multi-pass continuous method is shown in U.S. Pat. No. 4,664,528. Single-pass, continuous systems for dissolving water soluble polymers also exist. However, their successful operation critically depends on proper initial dispersal of the polymer as with batch systems. These methods use elaborate designs to provide uniform initial dispersal of the polymer but are not well suited to ensure dissolution if the initial dispersal is not uniform for any reason. Batch dissolution systems are more tolerant of poor initial dispersion because agitation overcomes the agglomeration resulting from poor dispersion.

An additional problem with many of the prior art methods of dissolving polymers is that a holding period of from two to ten hours is required to allow the properties of the solution to stabilize. During the holding period, the viscosity of the solution reaches an equilibrium, at which point the solution is ready for use. This step is sometimes referred to as hydrolysis. This stabilization period requires holding tanks in addition to whatever mixing equipment is used and adds an additional complicating factor to running a continuous operation.

Therefore, a need exists for a polymer dissolution system that does not subject the polymer molecules to high shear rates. Such a device must be able to completely dissolve even large clumps of polymer at useful rates while preserving the effectiveness of the polymer. Such a device should also operate with low energy input. It should also ensure dissolution without being critically dependent uniform initial dispersal of the polymer in the water. Finally, it should allow for a constant flow of solution without a holding time to allow the solution properties to stabilize.

SUMMARY OF THE INVENTION

The invention uses dispersal elements to ensure the dispersal and eventual dissolution of water-soluble polymers. Solid particles are metered into a liquid solvent using a screw feeder. The solvent, such as water, carries the undissolved solid, such as a polymer, with the fluid flow until a dispersal element is encountered. The uniform dispersal of undissolved polymer in the solvent is aided by the dispersal element. The dispersal elements do not clog up as sieves do. The solvent and dissolved solids pass through essentially unrestrained while undissolved solids are dispersed within the liquid. Any polymer that remains undissolved at the end of the dispersal unit is trapped by and forced through a sieve to further reduce the size of the particles and aid in dispersing them in the water. Forcing the polymer through a sieve significantly reduces the solution stabilization time, enabling constant flow operations. The polymer is held in a gently agitated holding tank until complete dissolution occurs.

DETAILED DESCRIPTION

Figure 1:
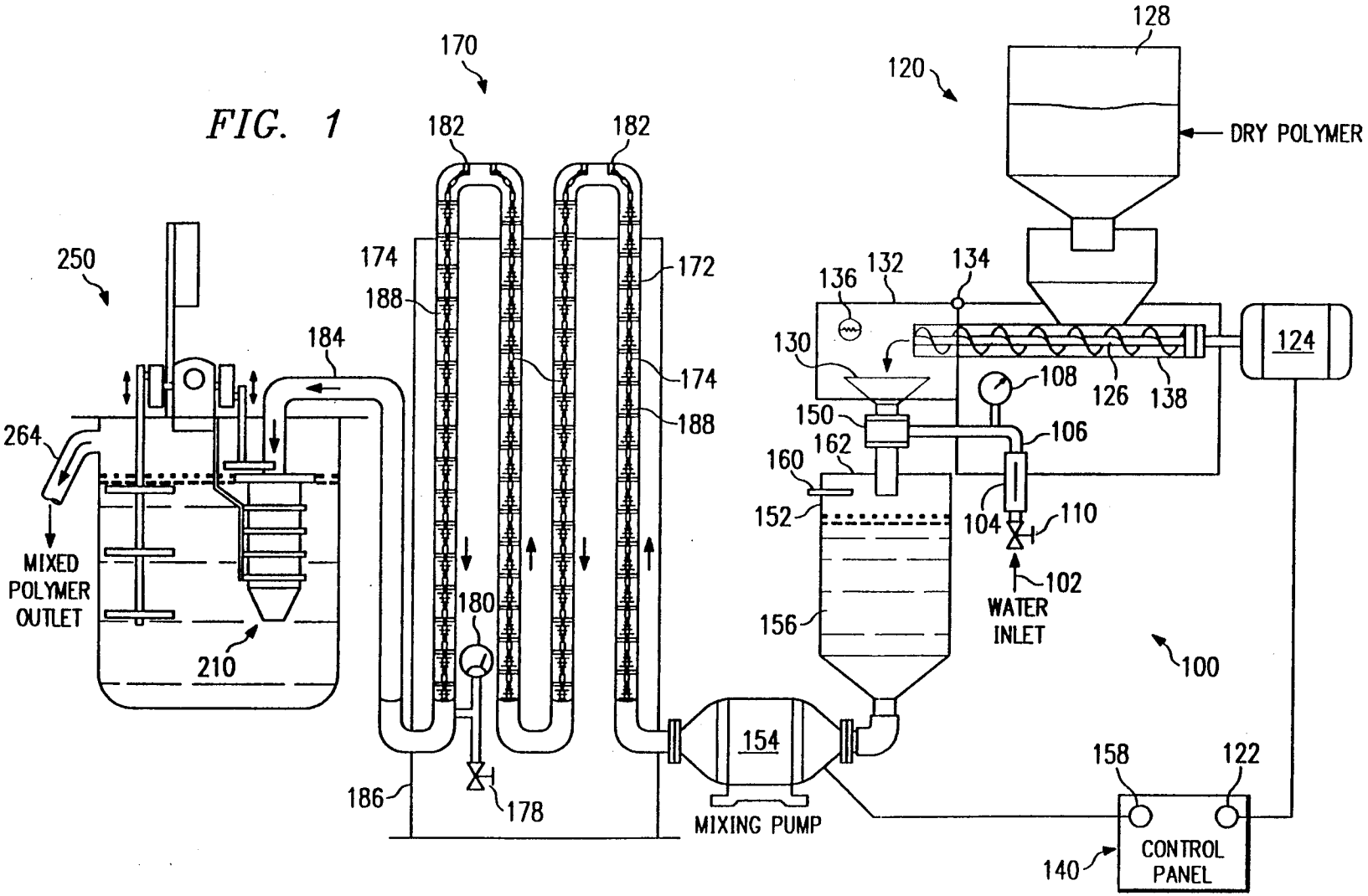
FIG. 1 is a schematic of the invention showing the polymer supply system, water inlet system, dispersal unit, sieve assembly, and holding tank.
Figure 3:
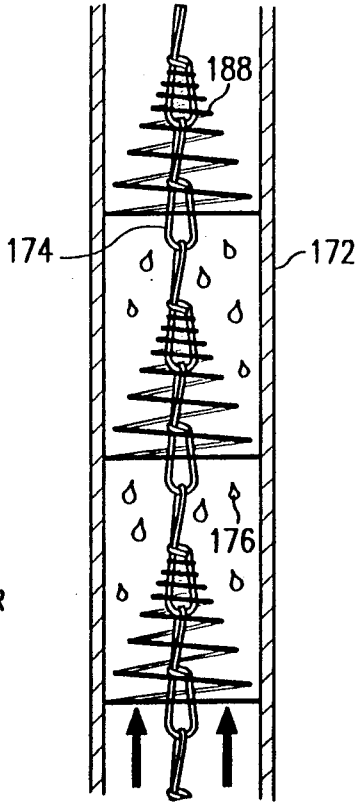
FIG. 3 is a drawing of an embodiment of a dispersal element attached to a dispersal element support inside a mixture conduit.
Figure 2:
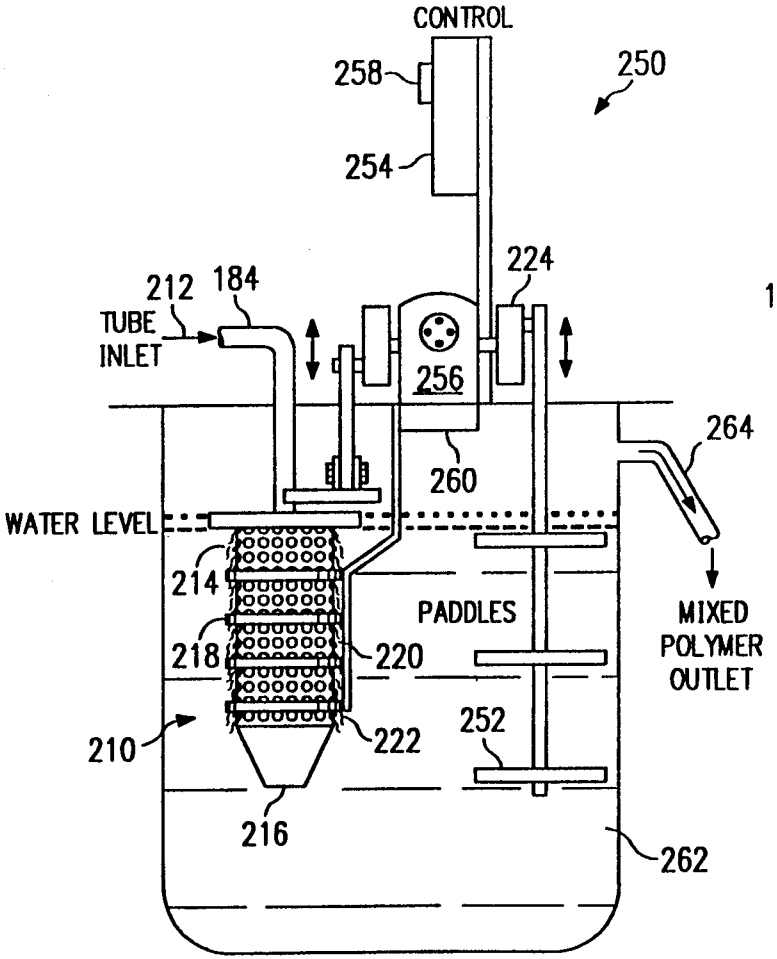
FIG. 2 is a detailed drawing of a sieve assembly and solution holding container.

Referring to FIGS. 1, 2, and 3 simultaneously, a low shear solids dispersal apparatus is comprised of water supply system 100, polymer supply system 120, dispersal unit 170, sieve assembly 210, and holding tank 250. Although the invention is applicable to dispersing any solid into any liquid, it will be described in terms of water-soluble polymers and water. It will be understood that the invention relates to systems in which the solid dissolves in the liquid and systems in which the solids disperses but does not dissolve in the dispersing liquid.

The water supply system 100 is comprised of a water supply inlet 102, water flow meter 104, and a first water conduit 106 connecting the water supply to the polymer mixing chamber 150. The water supply system may optionally include a water inlet temperature indicator 108. If desired, a temperature control system may be added to the apparatus at any point. The water flow rate is controlled by flow rate control valve 110. The water supply flow rate may be controlled by adjusting flow rate control valve 110 or in any convenient fashion. Water flows through flow meter 104 and is combined with polymer material provided by polymer supply system 120. The water flow meter 104 may be of any type.

Polymer supply system 120 includes a polymer feed rate controller 122 mounted in control panel 140 and screw feed 126 driven by polymer feed motor 124. Polymer is added to polymer inlet hopper 128 which supplies polymer to screw feed 126. The screw feed 126 pushes polymer through and out of polymer conduit 138 at a rate controlled by polymer feed rate controller 122. The polymer falls from the end of polymer conduit 138 into funnel 130. In order to prevent polymer from being blown away, the path from the end of polymer conduit 138 to funnel 130 is protected by dust hood 132 which is pivotally attached to the polymer supply system 120 by hinge 134. The dust hood 132 pivots on hinge 134 to allow access to polymer conduit 138 and funnel 130. Polymer heater 136 is placed inside dust hood 132 to reduce the relative humidity in the hood and thereby reduce polymer clumping.

The polymer feed rate is controlled by the rotation speed of the screw to meter the polymer material into the water at the proper rate. While a screw feed system is shown, any means for controlling the addition rate of polymer would be in accordance with the invention. For example, if the undissolved polymer material is supplied in an emulsion, a positive displacement pump with rate control could be used to meter the polymer into the system.

The polymer falls through funnel 130 into the optional polymer-water mixing chamber 150. The polymer material and water may also be metered directly into the mixture feed tank 152. After the polymer is combined with the water but prior to dissolving, the combination is referred to as a mixture. The mixture may be in either slurry or emulsion form and may contain entrained air bubbles. Mixture feed tank 152 is covered by tank lid 162. To prevent spills, the mixture feed tank 152 includes a high level shut-off 160 that stops the supply of water to the mixture feed tank 152 if the mixture level exceeds a predetermined level. The combined polymer-water mixture 156 leaves mixing chamber 150 and falls into the mixture feed tank 152 which supplies mixture pump 154.

The invention ensures complete dispersal so mixture feed tank 152 does not need to be stirred prior to pumping into the dispersal unit 170.

The dispersal unit 170 is comprised of mixture pump 154, mixture feed rate controller 158, one or more mixture transport conduits 172, and one or more dispersal elements 188 attached to dispersal element supports 174. FIG. 3 is a detail view of a section of the dispersal unit 170. Mixture pump 154 pumps the mixture of undissolved polymer and water into the first mixture conduit 172. The dispersal unit 170 is supported by support structure 186. Although the apparatus is described as a dispersal unit, no particular theory of the invention is claimed nor is the invention limited to any particular theory.

Dispersal elements 188 are disposed throughout the first mixture conduit 172. One embodiment involves dispersal elements 188 that are coils of wire, spaced approximately six inches (6") apart, attached to a dispersal element support 174 such as a chain 174. The chain is suspended within each conduit from chain attachment point 182 to distribute the dispersal elements 188 throughout the mixture conduit 172. The dispersal elements 188 may be any material, design, and spacing that will aid uniform dispersal of undissolved polymer particles without clogging. For easily dissolved polymer, low polymer concentrations, or other appropriate cases, the dispersal unit 170 may be omitted.

Early in the dispersal unit 170, the mixture contains clumps of polymer particles entrained in the water stream. The clumps of undissolved polymer particles 176 encounter the dispersal elements 188 as they flow through the conduit. When a clump of polymer particles encounters a dispersal element 188, the clump tends to break up into its constituent particles. The polymer particles that were in clumps are thus dispersed in the water. The dispersal occurs in a low shear environment that protects the polymer.

The clumps of undissolved particles which encounter the dispersal elements 188 may dislodge prior to complete breakup of the clump and continue to move through the conduit with the fluid flow. As the clumps of particles continue to move through the fluid transport conduit 172, they again encounter the dispersal elements 188, are broken into smaller clumps and dispersed in the water stream.

The repeated process of dispersal, partial breakup, motion further in the conduit, additional dispersal and breakup leads to substantially uniform dispersal of the polymer particles in the water prior to exiting from the dispersal unit 170. Prior to the exit of the dispersal unit 170, a sample tap 178 and a pressure gauge 180 may be connected to a mixture transport conduit 172. The pressure gauge 180 measures the buildup of pressure at the sieve. The sample tap 178 allows intermediate samples to be taken for process monitoring.

Undissolved polymer particles 176 are transported to sieve assembly 210 through flexible conduit 184. Referring now specifically to FIG. 2, sieve assembly 210 comprises solution inlet 212, solution sieve 214, sieve canister 216, sieve rings 218, speed controller 254, drive system 224, and control knob 258. Undissolved polymer particles 176 (not shown) are further reduced in size by being pumped through solution sieve 214 that may be of any predetermined size, 40 mesh or approximately 400 microns being a typical example. Particles larger than the sieve size are reduced to the sieve size before passing through to the holding tank.

The undissolved polymer forms a film 220 on the outside of the sieve canister 216. In order to complete the dissolution of the polymers, the film 220 must be dispersed within the polymer solution 262 contained in holding tank 250. This is accomplished by moving sieve canister 216 up and down against sieve rings 218 rigidly attached to support beam 260. An alternative embodiment accomplishes film removal by moving the rings 218 against a stationary sieve canister 216. The sieve rings 218 remove the film 220 from the sieve canister 216 and disperse it within the holding tank 250. The sieve rings 218 are spaced a distance 222, typically ¼ to ½ inch, from the sieve canister 216 and are driven by drive system 224. Other methods of film removal would also be in accordance with the invention. For example, a jet of liquid that washed the film off the sieve canister 216 would be in accordance with the invention.

The connection from the dispersal unit 170 to sieve assembly 210 is made by flexible conduit 184 to allow the sieve canister 216 to be moved up and down against sieve rings 218. High polymer quantities and polymer that forms a thicker film 220 require more frequent removal by sieve rings 218; therefore, the rate of sieve canister 216 movement is adjustable. The oscillation speed is controlled by speed controller 254 adjusted by speed control knob 258. Although a particular embodiment has been described, sieve assembly 210 may be replaced by any apparatus that aids in dispersion and dissolution by reducing the size of the largest remaining particles and ensures their distribution into the holding tank 250.

Figure 4:
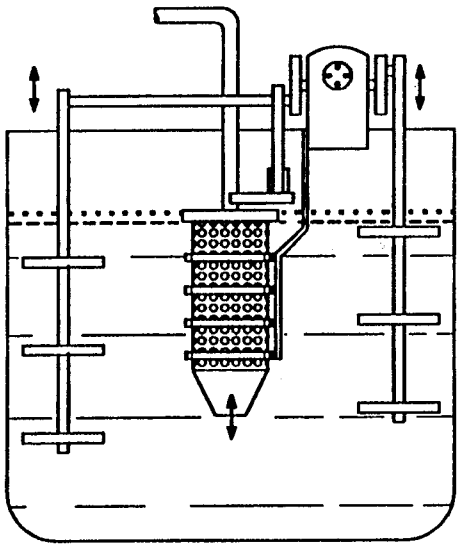
FIG. 4 is a schematic representation of an alternative embodiment of a sieve assembly and solution holding container showing two sets of oppositely acting paddles.

Once separated from the sieve canister, the polymer particles are in suspension in the holding tank 250. The holding tank 250 is gently agitated by paddles 252 driven through gear reducer 256. The agitation rate is also controlled by speed controller 254 so that the agitation rate and sieve oscillation rate are synchronized. However, separate agitation and sieve movement rates would be in accordance with the invention. FIG. 4 shows an alternate embodiment that includes counter-oscillating paddles. The paddles consist of a horizontal plate of a predetermined shape and size to cause a gentle wave action within the tank 250 when moved vertically by drive system 224. The gentle agitation leads to complete dissolution of the polymer in a low shear environment that does not damage the polymer.

The holding tank 250 size is selected to provide sufficient residence time to allow complete stabilization or hydrolyzation. The invention has the benefit of substantially speeding the stabilization of the solution properties so the size of holding tank 250 is typically much smaller than a tank required for other systems of equivalent polymer processing capacity. The stabilization or equilibrium period after initial mixing is sometimes called the hydrolyzation period. Polymer-water solution is continuously removed through solution outlet 264, providing a constant flow of solution for use. A constant flow of polymer solution is available for use after the holding tank 250 is full or when a predetermined volume is reached which allows solution to be withdrawn from the holding tank 250. The holding tank 250 liquid volume is typically 15 to 30 times the average volumetric flow rate of liquid per minute but could be as large as 120 times the average volumetric flow rate of liquid per minute. Larger volumes could be used in accordance with the invention but one of the benefits of the invention would be lost.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications, and substitutions of parts and elements as fall within the scope of the present invention.

I claim:

1. An apparatus for dispersing solid particles in a liquid, said apparatus comprising a conduit for transporting a liquid and solid particles while said solid particles are being dispersed in said liquid, said conduit having an inlet and an outlet, said solid particles having a tendency to agglomerate, a plurality of dispersal members disposed within and spaced apart along the length of a portion of said conduit so as to encounter the solid particles which are entrained in the liquid, said plurality of dispersal members promoting the dispersal of the solid particles within the liquid without subjecting the solid particles to high shear rates, each of said plurality of dispersal members being comprised of a coil of wire that spirals outwardly towards the wall of said conduit, wherein each coil of wire is sized so as to permit the liquid and any dissolved solids contained therein to pass therethrough essentially unrestrained while any agglomeration of said particles tends to break up into its constituent particles upon encountering one of said coils of wire, and a retainer connected to the outlet of the conduit with said retainer having undissolved solid particles until they are reduced to the predetermined maximum size, thereby providing a low shear environment for the dispersal of said solid particles while protecting said solid particles.

2. An apparatus as in claim 1 wherein said retainer is comprised of a sieve.

3. An apparatus as in claim 1 wherein said retainer is comprised of a filter.

4. An apparatus as in claim 1 wherein said retainer is contained within a housing to provide structural support for said retainer without substantially restricting the flow of either liquid or undissolved solids.

5. An apparatus as in claim 1 further comprising a means to remove a buildup of undissolved solid on the outside of said retainer.

6. An apparatus as in claim 1 further comprising rigid rings surrounding said retainer wherein said retainer and said rings are slidably movable one against the other to remove said buildup.

7. An apparatus as in claim 1 wherein said retainer has an outlet, wherein said solid particles are soluble in said liquid, and further comprising:

a container connected to the outlet of said retainer to receive the solution and any remaining particles which have been reduced to said predetermined maximum size.

8. An apparatus as in claim 7 wherein said container includes an agitation means that does not damage the undissolved solid particles.

9. An apparatus as in claim 7 wherein said container includes vertically movable horizontal planar paddles that cause wave action within said container.

* * * * *

UNITED STATES PATENT AND TRADEMARK OFFICE

CERTIFICATE OF CORRECTION

PATENT NO. : 5,174,651

DATED : December 29, 1992

INVENTOR(S) : Preston G. Gaddis

It is certified that error appears in the above-identified patent and that said Letters Patent is hereby corrected as shown below:

Column 6, line 28, after "having", insert --openings of a predetermined maximum size to retain--.

Signed and Sealed this

Twelfth Day of October, 1993

*Attest:*

*Attesting Officer*

BRUCE LEHMAN

*Commissioner of Patents and Trademarks*